US005502994A

United States Patent [19]

Katoh et al.

[11] Patent Number: 5,502,994

[45] Date of Patent: Apr. 2, 1996

[54] METHOD FOR PRODUCING A METAL TIP

[75] Inventors: Akio Katoh, Nishio; Kazuo Hamada, Hadano, both of Japan

[73] Assignees: Nippondenso Co., Ltd., Kariya; Kataken Seiko Co., Ltd., Isehara, both of Japan

[21] Appl. No.: 213,013

[22] Filed: Mar. 14, 1994

[30] Foreign Application Priority Data

Mar. 18, 1993 [JP] Japan ..... 5-084085

[51] Int. Cl.[6] ..... B21D 28/10

[52] U.S. Cl. ..... 72/327; 72/358; 29/874

[58] Field of Search ..... 72/326, 327, 329, 72/358, 254, 355.2, 355.4, 355.6, 372; 29/874

[56] References Cited

U.S. PATENT DOCUMENTS

| | | | |
|---|---|---|---|
| 1,691,878 | 11/1928 | Blakeslee | 72/327 |
| 4,352,283 | 10/1982 | Bailey | 72/358 |
| 4,435,973 | 3/1984 | Nakazawa | 72/327 |
| 4,575,343 | 3/1986 | Kin | 72/258 |

FOREIGN PATENT DOCUMENTS

| | | | |
|---|---|---|---|
| 535584 | 4/1993 | European Pat. Off. . | |
| 620830 | 5/1961 | Italy | 29/874 |
| 55-19768 | 2/1980 | Japan . | |
| 59-33949 | 8/1984 | Japan . | |
| 60-44133 | 3/1985 | Japan . | |
| 3225783 | 10/1991 | Japan . | |
| 4242090 | 8/1992 | Japan . | |

*Primary Examiner*—Daniel C. Crane

[57] ABSTRACT

A cold forging apparatus for producing a metal tip for use, for example, in an electrode of a spark plug includes an intermediate die for receiving a metal blank, an upper die having a punch for forming a recess in the metal blank, and a lower die movable in a lateral direction. A press member is mounted on the lower die, and is retracted when a projection, extruded from the metal tip by the punch, is brought into pressing engagement with the press member. The punch is driven into the metal blank to form a recess and the projection respectively on upper and lower surfaces of the metal blank, and subsequently in a hydrostatic condition, the lower die is moved laterally to remove the projection from the metal blank.

14 Claims, 13 Drawing Sheets

METHOD FOR PRODUCING A METAL TIP

BACKGROUND OF THE INVENTION

This invention relates to a method of and an apparatus for producing a pillar-like metal tip, especially for use as an electrode of a spark plug or the like. The invention also relates to a spark plug employing such a metal tip.

As shown in FIG. 14, a spark plug 90 for internal combustion engines includes a central electrode 92 provided in an insulator 91, and an earth electrode 93 provided at a lower end portion of a housing 95. A type of spark plug is known in which a metal tip is used at a discharge end 94 of the central electrode 92 or the earth electrode 93.

This metal tip must be resistant resistance to a discharge and a heat resistance. In many cases, noble metal such as platinum is used for forming the metal tip. In FIG. 14, the reference numeral 951 denotes a mounting threaded portion, the reference numeral 952 a central stem, the reference numeral 953 a ring, the reference numeral 954 a packing, and the reference numeral 955 an electrically-conductive glass seal material.

In order to decrease a voltage (hereinafter referred to as "required voltage") needed for initiating a spark discharge, and also to enhance the ignitability of a fuel mixture, it has been proposed to form a groove-like recess in a distal end of the metal tip (see Japanese Patent Unexamined Publication No. 55-19768, Japanese Patent Examined Publication No. 59-33949 and Japanese Patent Unexamined Publication No. 3-225783).

More specifically, such a metal tip 941 has a recess 942 at its central portion, and flat projection surface portions 943 are provided immediately adjacent to the recess 942, and a connecting portion 944 having a thickness t is provided at a bottom thereof, as shown in FIG. 15.

The metal tip 941 is joined or welded to the distal end of the central electrode 92 to serve as the discharge end 94 of the central electrode 92. When the spark plug is used for a long period of time, the projection surface portions 943 of the metal tip 941 are worn down by the spark discharge, as indicated by broken lines in FIG. 16.

As a result, as seen in FIG. 16, the discharge gap increases from $G_1$ to $G_2$, so that the required voltage increases. When the lifetime of the spark plug expires, the spark plug, including the metal tip 941 made from noble metal or the like, is discarded.

Japanese Patent Unexamined Publication No. 55-19768 and Japanese Patent Examined Publication No. 59-33949 disclose a method of producing a pillar-like metal tip of the type described having a recess, in which the groove-like recess is formed by cutting or severing.

With such a method, however, an unsatisfactory straightness of the central electrode, displacement of a chuck for holding the central electrode, and displacement of a cutting tool jointly contribute to irregularities in the position of formation of the groove-like recess 942 and in dimensions of the groove, so that the projection surface portions 943 vary in size.

As a result, the spark discharge concentrates mainly on the projection surface portion 943 having a smaller area, and an electrode pole having this projection surface portion 943 with a smaller area is worn and exhausted. Thus, the number of discharge poles decreases, and the effect of decreasing the required voltage, which the above Japanese Patent Examined Publication No. 59-33949 seeks to achieve, is adversely affected.

Furthermore, due to variations in the position and dimension of the groove-like recess 942, that area of the discharge end 94 of the central electrode which serves to achieve a quenching effect is also varied, so that the ignitability of a fuel mixture, which the above Japanese Patent Unexamined Publication No. 55-19768 seeks to achieve, is varied.

The above Japanese Patent Unexamined Publication No. 3-225783 discloses a method in which a noble metal tip is joined to a distal end of a central electrode, and then a groove-like recess is formed in this metal tip by cutting. In this case, a problem is encountered in that the expensive noble metal is wasted in the form of cuttings or chips. Even if recovery of the cuttings of the noble metal is attempted, this is difficult because such cuttings are mixed with cuttings of other electrode materials.

Moreover, the method of forming the recess in the metal tip by cutting is not satisfactory in that much time and labor are required, thus increasing the cost. More specifically, much time and labor are required because the feeding speed of the cutting tool is low and also because an additional step of holding the central electrode with a chuck is required before the cutting operation.

Another problem is that the recess formed by cutting is limited to a straight groove-shape, and therefore the cross-sectional shape of the projection surface portion 943 is very limited, and hence is not always the optimum one. Here, the optimum cross-sectional shape means a shape best suited for enhancing the ignitability of a fuel mixture, the required voltage characteristic, and the lifetime of the electrode.

Apart from the above processing method depending on the cutting operation, a processing method is known depending on cold forging, in which processed dimensions are stable, less time and labor are required, and materials or blanks are not wasted.

One example of method of producing a metal tip with a recess by cold forging is a forward-extruding method shown in FIG. 17, in which a projection 962 corresponding in shape to a desired recess is formed on a bottom surface 961 of a die 96, and a metal blank 97 is pressed by a punch 980 from the upper side, so that the metal blank 97 is extruded in a direction of advance of the punch 980.

Another example is a rearward-extruding method shown in FIG. 18, in which a punch 981 having a projection 982 corresponding in shape to a recess is pressed against a metal blank 97, so that the metal blank 97 is plastically flowed in a direction opposite to the direction of advance of the punch 981.

However, these cold forging methods have the following problems:

In the latter method, (that is, the rearward-extruding method), as the punch 981 advances, the metal blank 97 is flowed and deformed by the punch 981. In accordance with the flow and deformation of the metal blank 97, the punch 981 receives a large repulsion force from those portions of the metal blank which are not subjected to such flow and deformation.

The connecting portion (as at 944 in FIG. 15) of the metal tip should preferably be small in thickness t for reasons later described. But when, the thickness t of this connecting portion is made small, a frictional force between a die 96 and the punch 981 due to the flow and deformation of the metal blank 97 becomes extremely large. As a result, the punch 981 is liable to be broken.

For the same reason, in the former method, (that is, the forward-extruding method), the projection 962 of the die 96 is susceptible to breakage.

The hardness of the metal blank 97 corresponds to the likelihood that the projection 962 of the die 96 and the projection 982 of the punch 981 can be broken. The metal tip used for an electrode of a spark plug is made of a hard material having a Vickers hardness of 200~300, such as a heat resisting Ni alloy and a noble metal alloy.

Since an expensive material, such as a noble metal, is used for a spark plug, the thickness t (FIG. 15) of the connecting portion should be as small as possible in order to save the material. Therefore, the thickness t of the connecting portion is typically not more than 0.3 mm, so when producing the metal tip by cold forging, the projection of the punch or the die is quite susceptible to breakage.

SUMMARY OF THE INVENTION

With the above problems in view, it is an object of this invention to provide a method and apparatus capable of producing a pillar-like metal tip with uniformity and high precision, having a recess of various shapes, and at low costs.

A further object of the invention is to provide a pillar-like metal tip with uniformity, high precision and low cost, having a recess.

Another object of the invention is to provide a spark plug which has a discharge end made of such a metal tip, and is excellent in required voltage characteristics, and is excellent in ignitability.

According to one aspect of the present invention, a method is provided for producing a metal tip, including a pillar-like body having opposite ends and a recess with a bottom formed therein which extends from one of the opposite ends of the pillar-like body toward the other end thereof. The method comprises the steps of:

providing a pillar-like metal blank having opposite ends;

driving a punch partway into one of the opposite ends of the metal blank toward the other end thereof to form the recess in the metal blank, whereby a part of a the metal of the metal blank is extruded by the punch to form a projection extending from the other end of the metal blank in alignment with the recess and having a distal end directed away from the one end of the metal blank; and removing the projection from the metal blank while applying a force to all surfaces of the metal blank in a According to another aspect of the present invention, a method is provided for producing a metal tip including a pillar-like body having opposite ends and a recess with a bottom which extends from one of the opposite ends of the pillar-like body toward the other end thereof. The method comprises the steps of:

close-fitting a pillar-like metal blank into a die;

driving a punch partway into one end of the metal blank received in the die to form the recess and so that part of the metal of the metal blank is extruded by the punch to form a projection extending from the other end of the metal blank in alignment with the recess; and removing the projection from the metal blank by shearing while applying a force to all surfaces of the metal blank.

In the above methods, it is important to note that the punch is driven into the metal blank to form the recess in the upper surface thereof. At the same time, the projection (convex portion) is formed on the lower surface of the metal blank in alignment with this recess. Another important feature is that the projection on the metal blank is removed therefrom by shearing while a force is applied to all surfaces of the metal blank.

The recess and the projection can be formed simultaneously, for example, by a method in which a relief space for receiving the projection, extruded as a result of formation of the recess, is provided on the lower side of the die.

The projection is removed by shearing in which the metal blank having the projection is subjected to generally equal forces from the sides thereof.

Applying a force to all surfaces of the metal blank can be achieved, for example, by upwardly urging the projection, received in the relief space, by a balancing force, while pressing the metal blank, received in the die, by the punch. The shearing of the projection can be effected by laterally moving the relief space receiving the projection, in which case the relief space serves as a second die.

According to a further aspect of the present invention, a spark plug for internal combustion engines is provided comprising a central electrode, an earth electrode, and a pillar-like metal tip with a recess and mounted on at least one of the central electrode and the earth electrode;

the metal tip including a pillar-like body having opposite ends and a recess formed therein with a bottom which extends from one of the opposite ends of the pillar-like body toward the other end thereof. The metal tip is produced by the steps of:

providing a metal blank having a pillar-like body with opposite ends;

driving a punch partway into one of the opposite ends of the metal blank toward the other end thereof to form the recess in said metal blank, whereby part of the metal of the metal blank is extruded by the punch to form a projection having a distal end extending from the other end of the metal blank in alignment with the recess; and removing the projection from the metal blank while applying a force to all surfaces of the metal blank.

According to a still further aspect of the present invention, an apparatus is provided for producing a metal tip including a pillar-like body having opposite ends and a recess with a closed bottom which extends from one of the opposite ends of the pillar-like body toward the other end thereof. The apparatus comprises:

a first die for receiving a metal blank having a pillar-like body with opposite ends, the first die having opposite ends;

a punch mounted adjacent to one of the opposite ends of the first die for reciprocal movement for pressing the metal blank, received in the first die, from one of the opposite ends of the metal blank toward the other end thereof;

a second die provided in contact with the other end of the first die, the second die being reciprocally movable in a direction intersecting an axis of the first die; and a press member provided adjacent to the other end of the first die in opposed relation to the punch, the press member being urged toward the punch and being retractable in a direction away from the punch;

wherein the punch is driven into the metal blank, received in the first die, to form the recess extending from the one end of the metal blank toward the other end thereof, so that part of a material of the metal blank is extruded by the punch to retract the press member to thereby form a projection extending from the other end of the metal blank; and wherein the second die is moved relative to the first die while pressing the punch against the metal blank, thereby removing the projection by a shearing force produced by the cooperation of the second die with the first die.

DESCRIPTION OF THE PREFERRED EMBODIMENTS

This example shows a preferred embodiment of a cold forging apparatus of the present invention, as well as preferred embodiments of metal tips of the present invention used in a discharge end of a spark plug of the present invention. This example also shows a preferred embodiment of a method of the present invention performed by the above cold forging apparatus of the present invention.

Figure 1:
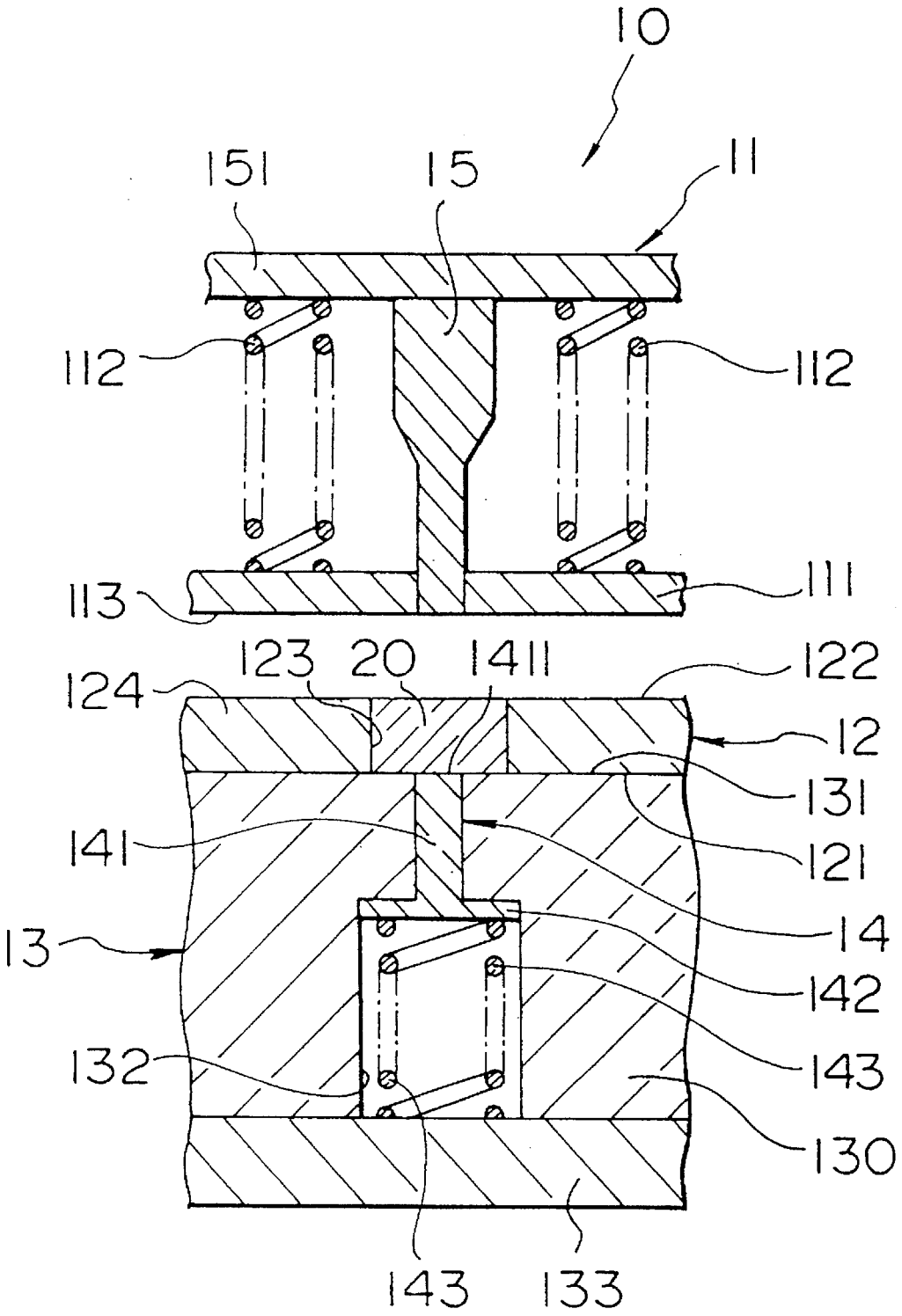
FIG. 1 is a cross-sectional view of a cold forging apparatus of the present invention, showing a punch in its inoperative position.
Figure 2:
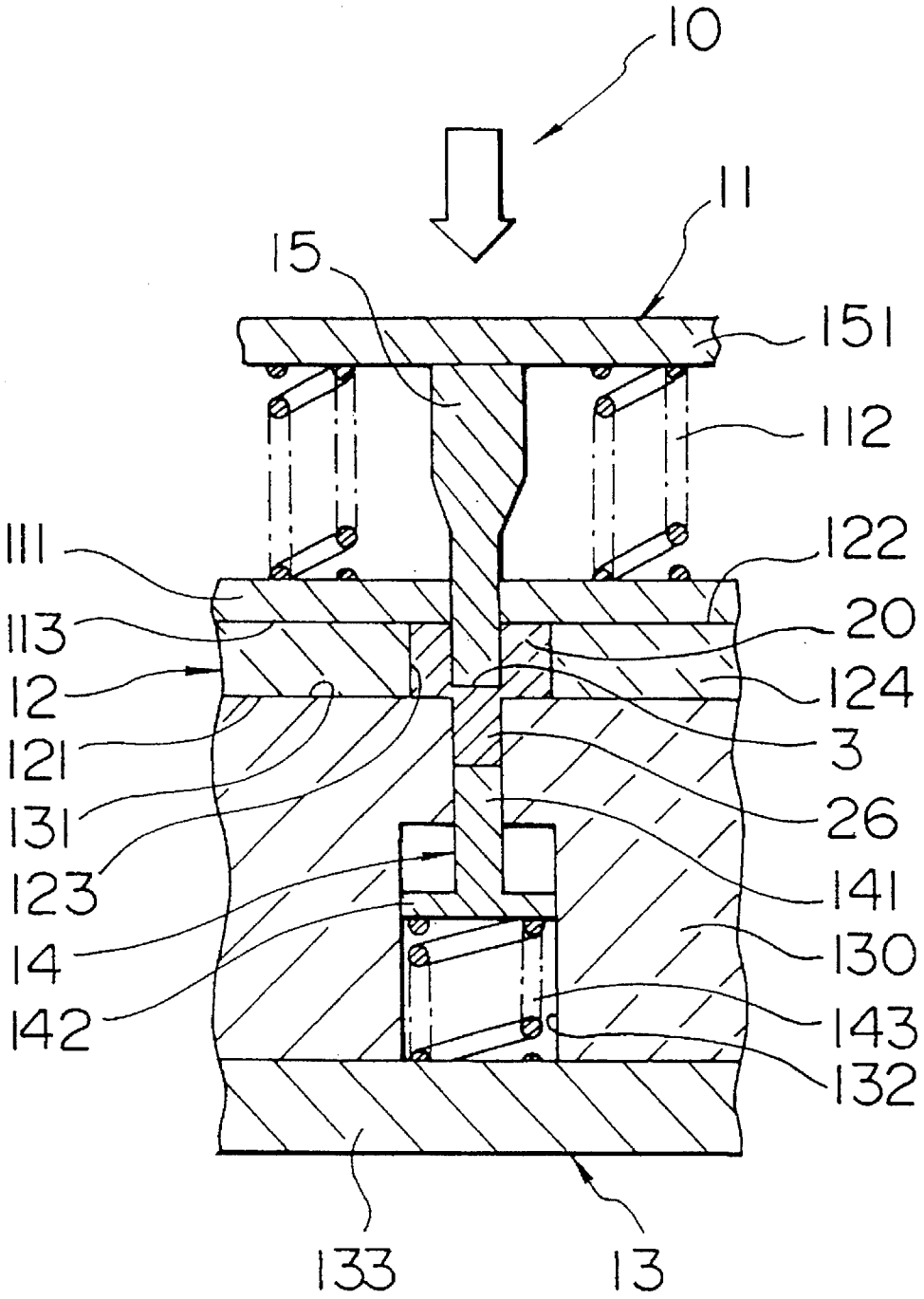
FIG. 2 is a cross-sectional view showing the punch in its operative position.
Figure 3:
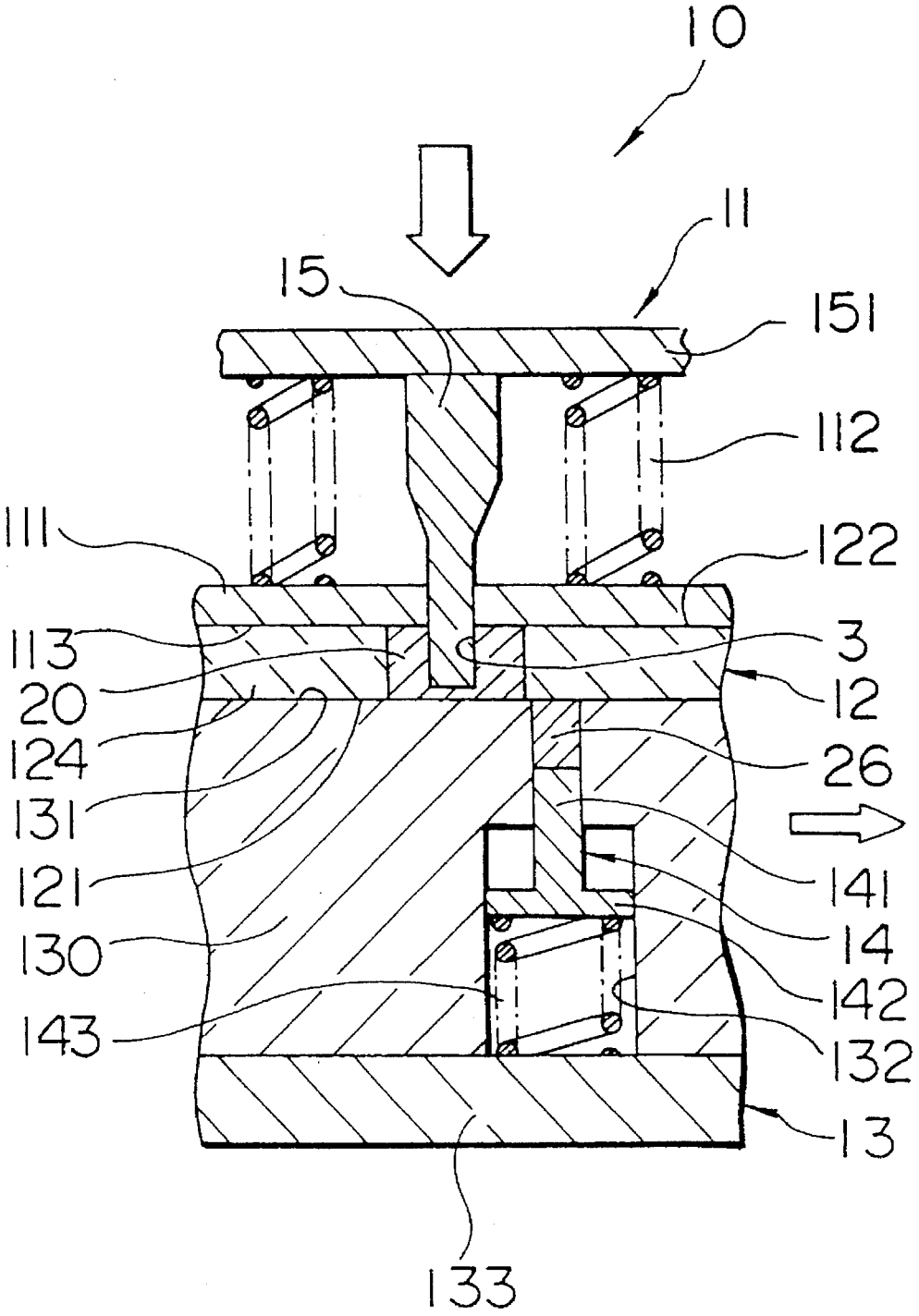
FIG. 3 is cross-sectional view showing the shearing of a projection.

As shown in FIGS. 1 to 3, a cold forging apparatus 10 of the present invention for producing a metal tip comprises an intermediate die 12 for closely holding a pillar-like metal blank 20 therein, an upper die 11 having a punch 15 for pressing against an upper surface of the metal blank 20 from above the intermediate die 12 to form a recess 3 (FIGS. 2 and 3) in the upper surface of the metal blank 20, and a lower die 13 which is laterally movable while in surface contact with a lower surface of the intermediate die 12.

An upwardly-urged press member 14 is provided in an upper portion of the lower die 13, and this press member 14 is forced to retract by a projection or excess portion 26 (FIGS. 2 and 3) extruded from the metal blank 20 upon pressing of the punch 15 from the intermediate die 12.

In the cold forging apparatus 10, the metal blank 20 received in the intermediate die 12 is pressed by the punch 15 of the upper die 11, so that the recess 3 is formed in the metal blank 20, as shown FIG. 2. Then, while applying a force to all surfaces of the metal blank 20 by the upper die 11 and the press member 14, the projection (convex portion) 26 is sheared or removed from the metal blank 20 by the lateral movement of the lower die 13.

FIGS. 4A to 8B show examples of pillar-like metal tips 21 to 25, respectively, which are produced by the cold forging apparatus 10 of this embodiment, and have recesses 31 to 35, respectively, formed in their end face 27 disposed perpendicular to an axis 29 of the metal tip.

Each of the pillar-like metal tips 21 to 25 is joined or welded to a discharge end 411,421 of at least one of a central electrode 41 and an earth electrode 42 of a spark plug 40, as shown in FIGS. 9 to 12.

The invention will now be described in further detail.

The metal blank (intermediate product) 20 to be processed or worked by the cold forging apparatus 10 of this embodiment is a platinum alloy consisting, by weight, of 78% Pt, 20% In and 2% Ni, and has a Vickers hardness of 300. The metal blank 20 is in the form of a cylinder having an outer diameter of 1.4 mm and a height of 0.8 mm. The metal blank 20 is formed by press blanking or wire cutting, and is a semifinished piece for forming a metal tip.

The cold forging apparatus of this embodiment comprises the intermediate die 12 for closely receiving the pillar-like metal blank 20 therein, the upper die 11 having the punch 15, and the laterally-movable lower die 13, as shown in FIGS. 1 to 3.

The upper die 11 comprises a punch plate 151 having the punch 15 integrally formed therewith, a punch guide 111 from which the distal end portion of the punch 15 can be projected, and upper die springs 112 provided between the punch plate 151 and the punch guide 111.

The upper die 11 is moved downward by a pushdown press (not shown) pressing the punch plate 151, and is brought into close contact with an upper surface 122 of the intermediate die 12, as shown in FIGS. 2 and 3.

The above pushdown press has such a stroke that it can further move the punch plate 151 downward against the bias of the upper die springs 112, thereby forming the recess 3 in the metal blank 20.

The intermediate die 12 has a die portion 123 of a cylindrical shape extending through an intermediate plate 124, and the die portion 123 can closely receive the metal blank 20 therein.

An upper surface 131 of the lower die 13 is held in surface contact with a lower surface 121 of the intermediate die 12, and the press member 14 is provided at a central portion of the lower die 13.

The press member 14 has a press pillar portion 141 of a smaller diameter, and a bottom portion 142 of a larger diameter formed on a lower end of the press pillar portion 141. A push spring 143 is held against the bottom portion 142 to urge the press member 14 upwardly.

A barrel portion 130 of the lower die 13 has a receiving hole or portion 132, and the outer peripheral surface of the press pillar portion 141 and the outer peripheral surface of the bottom portion 142 are disposed in close contact with the inner surface of the receiving portion 132. Usually, an upper surface 1411 of the press pillar portion 141 lies flush with an upper surface 131 of the barrel portion 130 to jointly constitute a flat surface, as shown in FIG. 1.

A bottom plate 133 is mounted on a lower surface of the barrel portion 130.

The lower die 13 is driven by a transverse drive device (not shown) to be moved laterally along the lower surface 121 of the intermediate die 12.

The operation of the cold forging apparatus 10 of this embodiment will now be described.

First, in a raised condition (FIG. 1) of the upper die 11, the metal blank 20 is inserted into the die portion 123 of the intermediate die 12. Then, the upper die 11 is moved downward by the above-mentioned pushdown press to bring a bottom surface 113 of the punch guide 111 into contact with the upper surface 122 of the intermediate die 12.

Then, the pushdown press continues to move the punch plate 151 and the punch 15 downward against the bias of the upper die springs 112. As a result, the recess 3 is formed in the upper surface of the metal blank 20 received in the intermediate die 12, as shown in FIG. 2.

At this time, the metal blank 20 is pressed by the punch 15 to be flowed, so that the projection 26 is formed on the lower surface of the metal blank 20. The flow of the metal blank 20 causes the press member 14, received in the lower die 13, to move downward into the receiving portion 132, thereby forming this projection 26. Thus, the receiving portion 132 for receiving the press member 14 also serves as a receiving portion for receiving the flowed portion of the metal blank 20 produced as a result of the pressing of the metal blank 20.

The projection 26 is urged upwardly by the bias of the push spring 143.

Then, in this condition, the lower die 13 is slidingly moved laterally to shear the projection 26, as shown in FIG. 3.

Collected sheared projections 26 are washed to remove grease or the like therefrom, and are melted and molded to be reused inexpensively as a metal blank.

Next, effects of the cold forging apparatus 10 of this embodiment will now be described.

Figure 17:
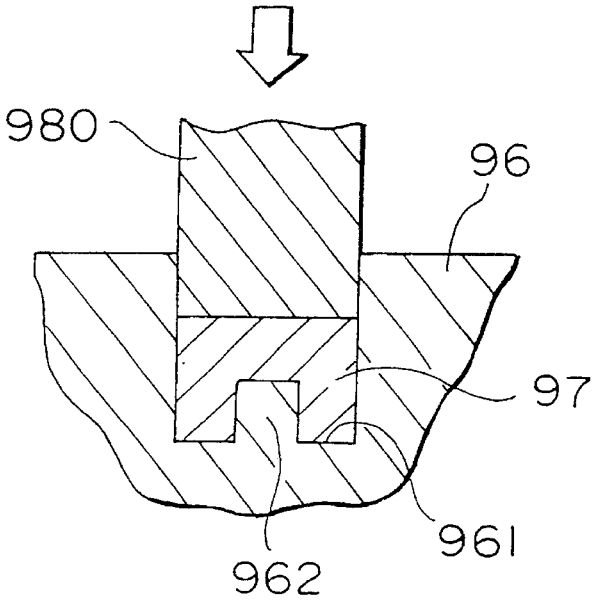
FIG. 17 (PRIOR ART)
FIG. 17 is a view showing a method of forming a conventional metal tip by cold forging.
Figure 18:
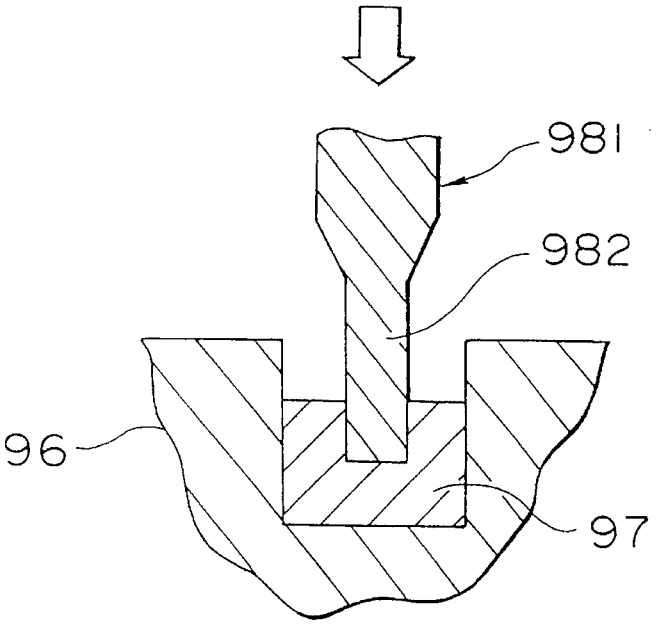
FIG. 18 (PRIOR ART)
FIG. 18 is a view showing another method of forming a conventional metal tip by cold forging.

In the cold forging apparatus 10 of this embodiment, the receiving portion 132 for receiving the flowed portion of the metal blank 20, produced when the recess 3 is formed in the metal blank 20 by the punch 15, is provided in the lower die 13. Namely, the recess is formed in such a manner that the flowed portion of the metal blank, produced upon formation of the recess, is allowed to escape downwardly without exerting any undue force on the die and the punch. Therefore, the projection 26 corresponding to the recess 3 is formed on the metal blank 20, and a reaction force acting on the punch 15 is greatly reduced as compared with the conventional cold forging apparatus (FIG. 18). Therefore, in contrast with the conventional cold forging methods (FIGS. 17 and 18), the punch and the die are less susceptible to breakage, and the metal tip can be produced in a stable manner.

Figure 15:
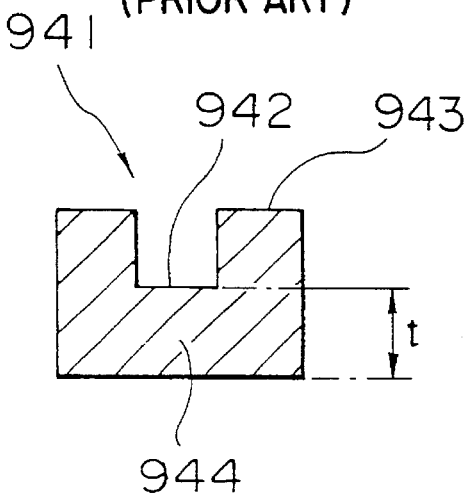
FIG. 15 (PRIOR ART)
FIG. 15 is a cross-sectional view of a metal tip provided at a discharge end of the conventional spark plug.
Figure 16:
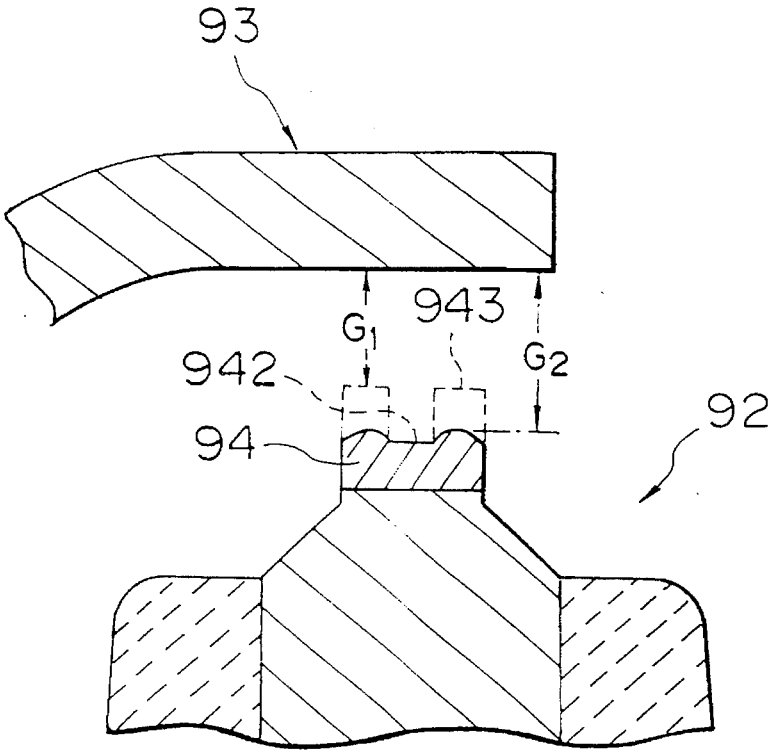
FIG. 16 (PRIOR ART)
FIG. 16 is a view explanatory of the discharge end of the conventional spark plug.

And besides, Since the load acting on the punch 15 is reduced, the punch 15 can be narrower or smaller in diameter, and the recess 3 having a greater depth can be formed. Namely, the punch can be forced deep into the metal blank so that the connecting portion (as at 944 in FIG. 15) of the metal tip can have a small thickness t.

The shearing of the projection 26 is effected, with a force being applied to all surfaces of the metal blank 20 such that the metal blank 20 is pressed upwardly and downwardly by the press member 14 and the punch 15, respectively. Therefore, a smooth cut surface can be formed at the lower surface of the metal blank 20, without causing any inconvenience such as breakage of the connecting portion due to the shearing of the projection 26. Also, even if the recess 3 is increased in depth, so that the thickness t of the connecting portion 28 (FIGS. 4 to 8) of each of the metal tips (finished products) 21 to 25 is reduced, any inconvenience, such as breakage or rupture (see FIG. 20) as in the conventional construction, will not be encountered.

This will now be explained with reference to FIGS. 13, 19, 20A and 20B.

Figure 19:
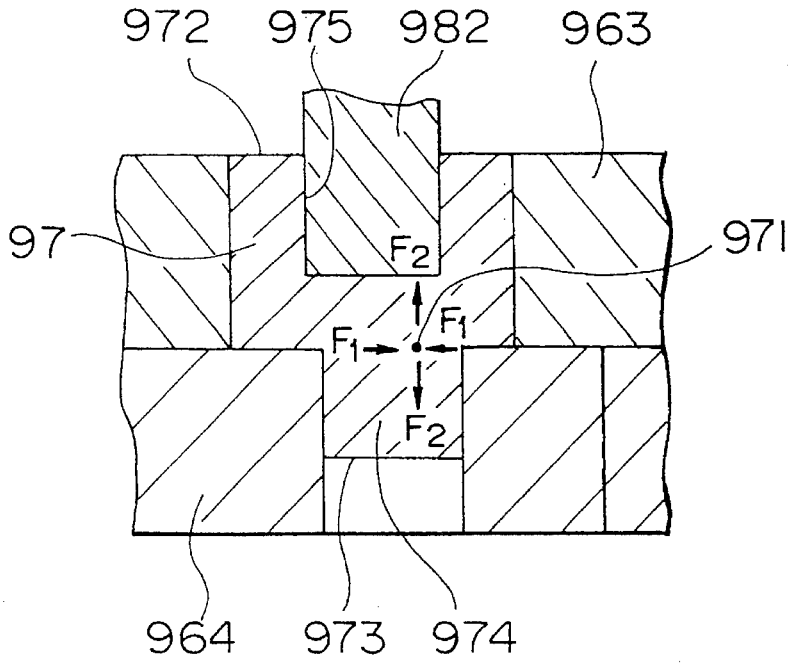
FIG. 19 is a view explanatory of stresses developing on a surface during the shearing of a lower portion of a metal blank, with upper and lower surfaces of the metal tip kept open.

As shown in FIG. 19, a metal blank 97 having a recess 975 is closely received in upper and lower dies 963 and 964, and the lower die 964 is slidingly moved laterally, with upper and lower surfaces 972 and 973 of the metal blank 97 kept open, thereby shearing a lower portion 974 of the metal blank 97.

At this time, compressive stresses $F_1$ act laterally on an arbitrary point 971 on a cut surface of the metal blank 97, and because of this compressive stresses $F_1$, upward and downward tensile stresses $F_2$ act on this point 971. Because of these tensile stresses $F_2$, the sheared surface of the metal-blank 97 is not made smooth, but is made very rough or coarse. The reference numeral 976 indicates an example of the sheared surface which is made greatly rough or coarse.

Figure 20A:
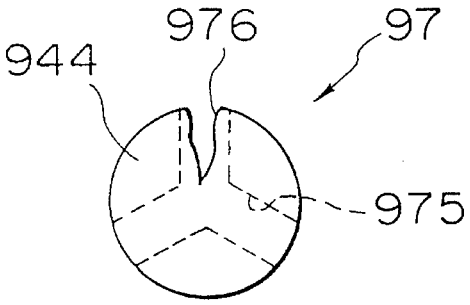
FIGS. 20A and 20B are views showing a rupture developing in the metal tip as a result of shearing of the lower portion of the metal blank when the upper and lower surfaces of the metal blank are kept open.
Figure 20B:
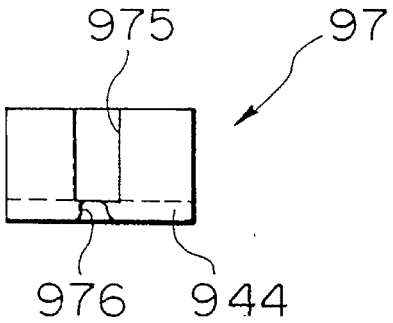

As apparent from FIGS. 20A and 20B, breakage or rupture develops in a connecting portion 944.

The metal tip having the above-described sheared surface which is made greatly rough, or the ruptured portion 976 is degraded in bonding or welding ability of the bottom surface thereof, and can not satisfactorily be used as a discharge end of an electrode of a spark plug.

Figure 13:
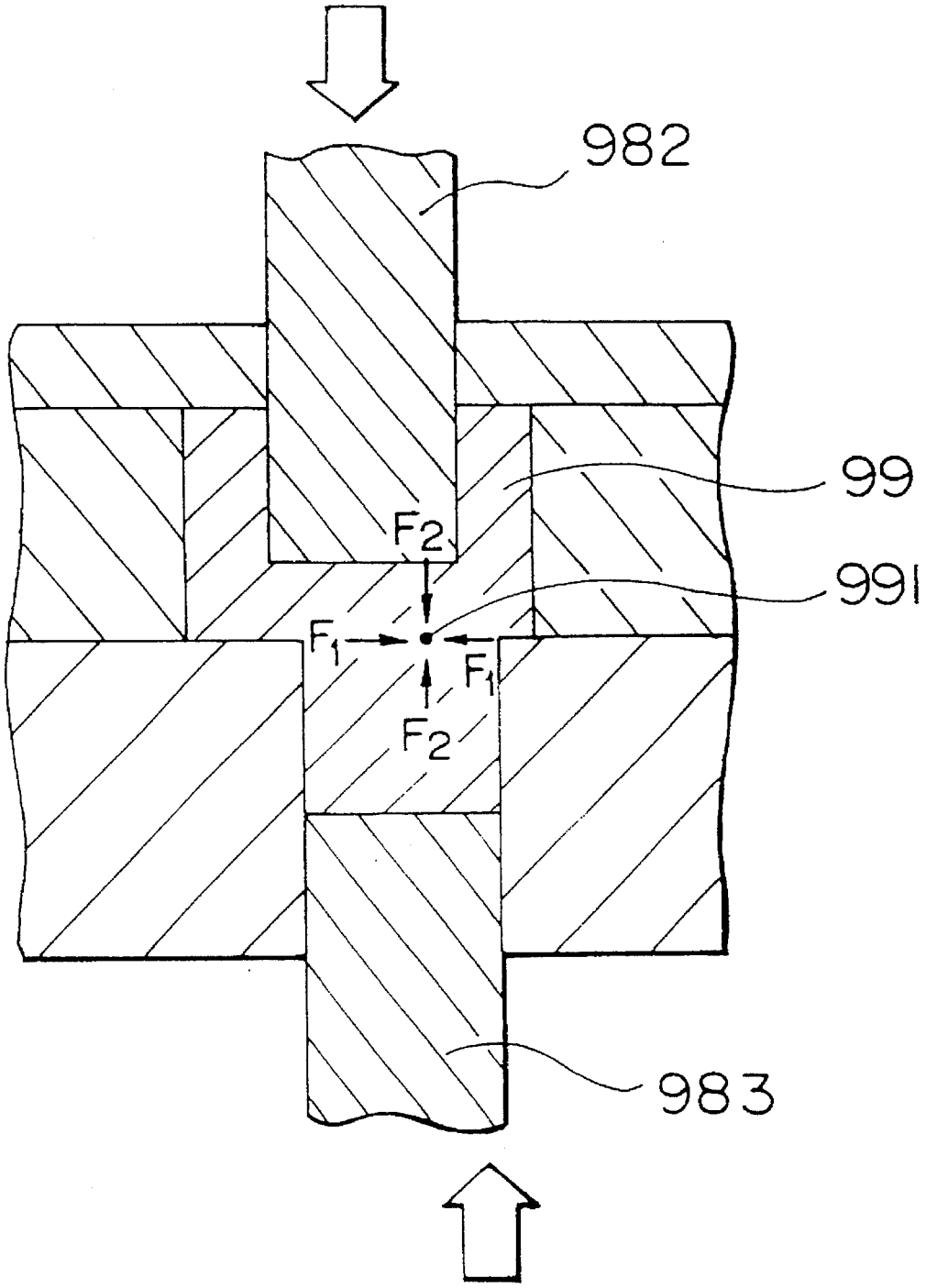
FIG. 13 is a view explanatory of stresses developing on a surface during a shearing operation in the cold forging apparatus of the present invention.
Figure 14:
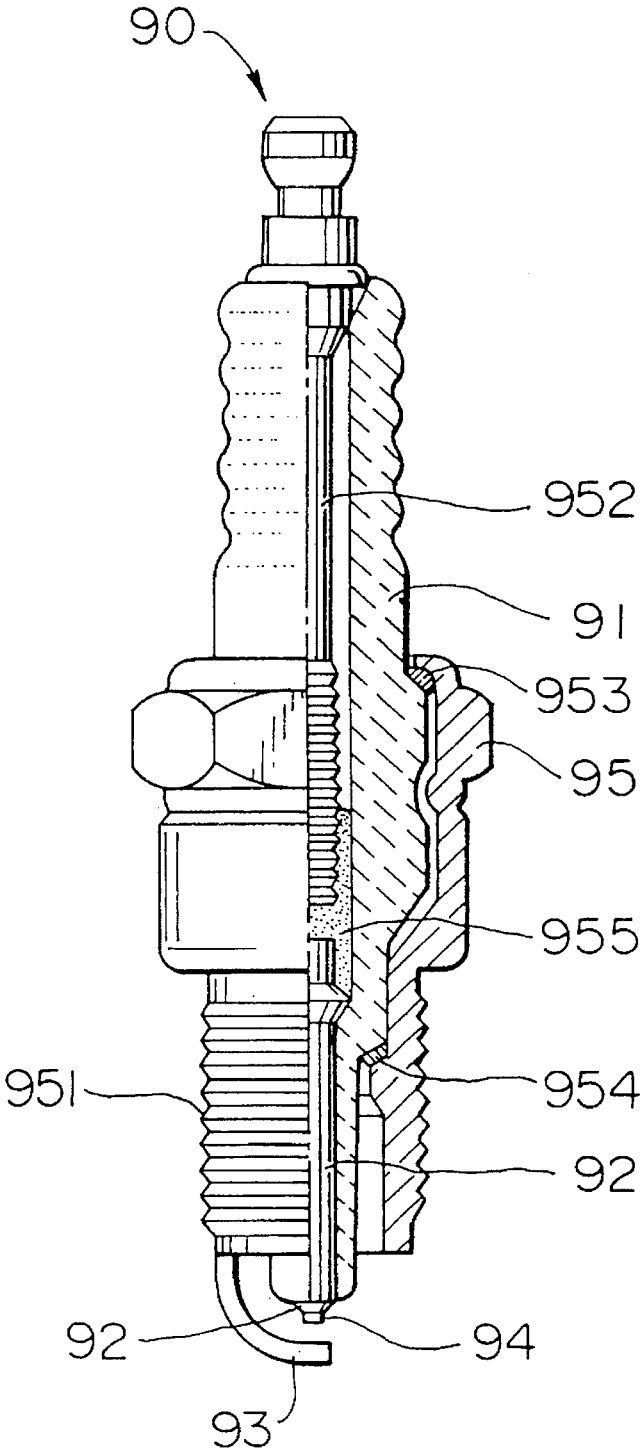
FIG. 14 (PRIOR ART)
FIG. 14 is a partly cross-sectional, front-elevational view of a conventional spark plug.

On the other hand, in a case where a metal blank 99 is sheared with punches 982 and 983 pressed respectively against upper and lower surfaces of the metal blank 99, as shown in FIG. 13, forces acting on an arbitrary point 991 on a cut surface in perpendicularly intersecting directions are compressive stresses $F_1$ and $F_2$. Therefore, the sheared surface of the metal blank 99 is a smooth flat surface.

Since the recess 3 is formed by the punch 15, the shape of the recess 3 is hardly limited in contrast with the case where the recess 3 is formed by cutting. Therefore, the recesses 31 to 35 of various shapes shown in FIGS. 4 to 8 can be easily formed.

Furthermore, since the metal tip-producing method of the present invention depends for its operation on cold forging, dimensions of the finish product are more uniform and precise than with a method depending on a cutting operation.

Therefore, with the cold forging apparatus of the present invention, time and labor required for the processing are greatly reduced as compared with a cutting operation, and the metal tips having uniformity and high precision can be easily mass-produced.

Moreover, the projection 26, produced as an excess portion upon formation of the recess 3, can be recovered at a rate of almost 100 % without being mixed with other material. Therefore, when using an expensive material for forming the metal tip, the consumption of the material is reduced, which reduces the cost.

Since the thickness t of the connecting portion 28 can be reduced, the volume of the metal tip can also be reduced, and therefore an expensive material such as noble metal can be saved.

As described above, in this embodiment, there is provided the cold forging apparatus by which the metal tip of uniformity and high precision having the recess can be produced at low costs, and besides the recess can have a wide variety of shapes.

FIGS. 4A to 8B show examples of metal tips produced by the cold forging apparatus 10 of this embodiment.

Figure 4A:
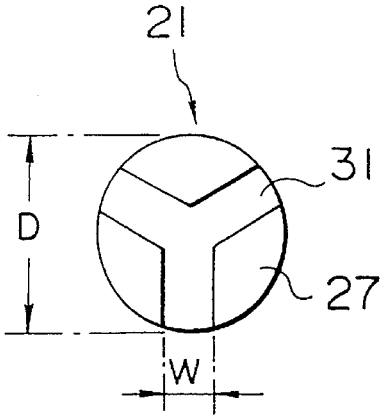
FIGS. 4A and 4B are a plan view and a front-elevational view of a pillar-like metal tip of the present invention, respectively.
Figure 4B:
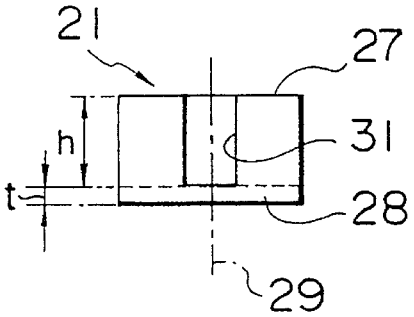
Figure 5A:
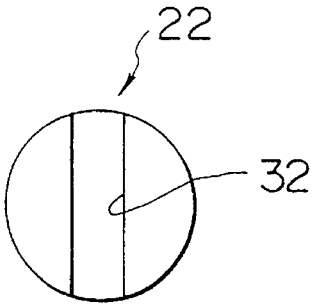
FIGS. 5A and 5B are a plan view and a front-elevational view of a modified pillar-like metal tip of the present invention, respectively.
Figure 5B:
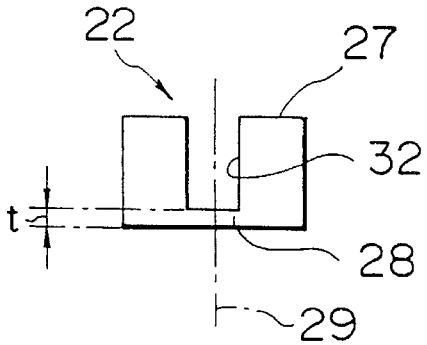
Figure 6A:
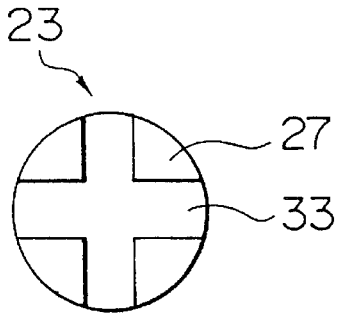
FIGS. 6A and 6B are a plan view and a front-elevational view of another modified pillar-like metal tip of the present invention, respectively.
Figure 6B:
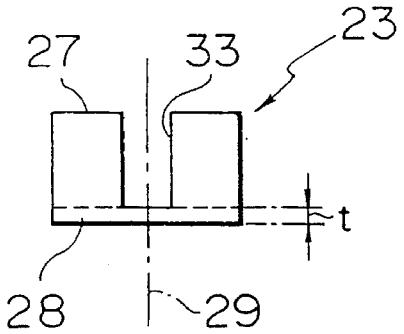
Figure 7A:
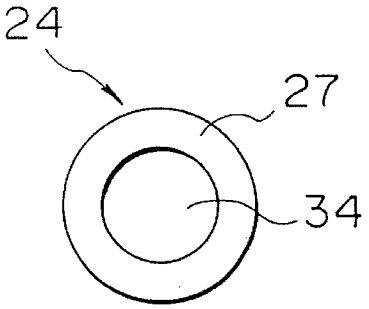
FIGS. 7A and 7B are a plan view and a front-elevational view of a further modified pillar-like metal tip of the present invention; respectively.
Figure 7B:
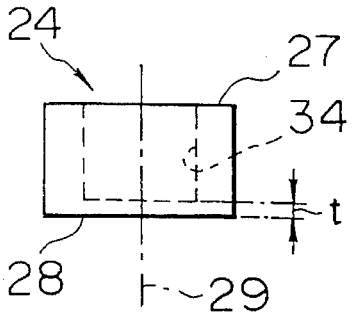
Figure 8A:
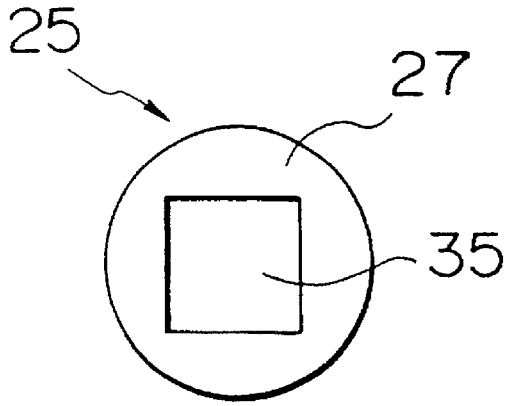
FIGS. 8A and 8B are a plan view and a front-elevational view of a still further modified pillar-like metal tip of the present invention, respectively.
Figure 8B:
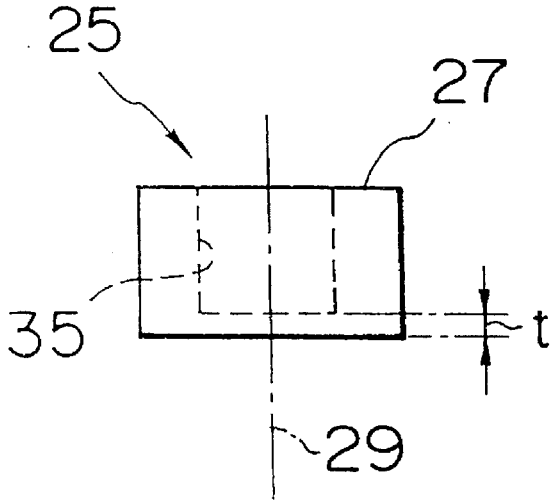

The recess 32 of FIG. 5 in the form of a straight groove, as well as the recess 33 of FIG. 6 in the form of a cross-shaped groove can be formed by a conventional cutting operation; however, the recess 31 of FIG. 4 in the form of a Y-shaped groove, the recess 34 of FIG. 7 in the form of a circular groove, and the recess 35 of FIG. 8 in the form of a rectangular groove can not be formed by the conventional cutting operation.

For example, referring to specific dimensions of the recess 31 defined by a Y-shaped groove, the outer diameter D of the metal tip 21 is 1.4 mm, the width w of the recess 31 is 0.4 mm, the thickness t of the connecting portion 28 is 0.1 mm, and the depth h of the recess 31 is 0.7 mm.

As described above, with the cold forging apparatus of this embodiment, there can be produced the metal tip, having the recess with a large depth (h) and a narrow width (w) and the connecting portion with a small thickness (t), which has not been produced with the conventional cold forging apparatus.

As described above, in this embodiment, the metal tips 21 to 25 of uniformity and high precision having the recess of various shapes can be produced inexpensively.

The metal tips 21 to 25 produced by the cold forging apparatus 10 of this embodiment are used as a discharge end 411 of a central electrode 41 and a discharge end 421 of an earth electrode 42, as shown in FIGS. 9 to 12.

Figure 9:
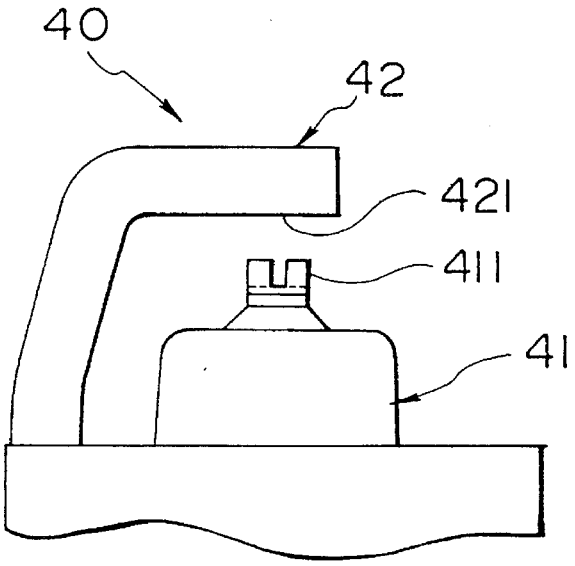
FIG. 9 is a view showing a metal tip of the present invention mounted on an electrode of a spark plug.
Figure 10:
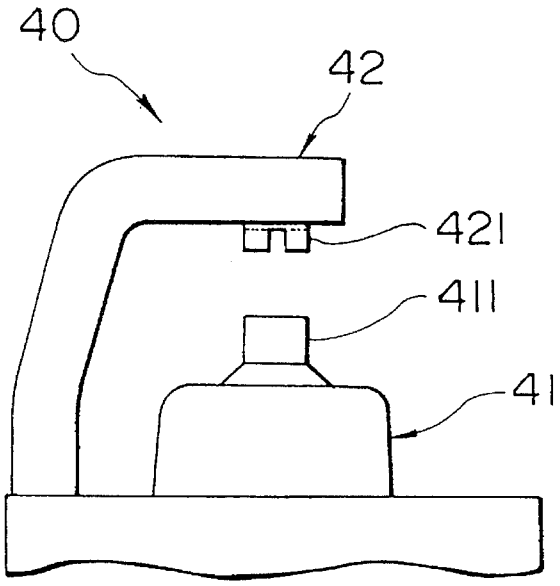
FIG. 10 is a view showing a metal tip of the present invention mounted on an electrode of a spark plug.

The metal tips 21 to 25 may be used in such a manner that the connecting portion 28 serves as a bonding surface for the electrode, with the recess 31 to 36 serving as a discharge side, as shown in FIGS. 9 and 10. The metal tips 21 to 25 may also be used in such a manner that the connecting portion 28 serves as a discharge surface, as shown in FIGS. 11 and 12.

Where the recess 31 to 35 serves as the discharge side as shown in FIGS. 9 and 10, the discharge surface has a reduced area, so that the effect of reducing the required voltage is achieved.

Figure 11:
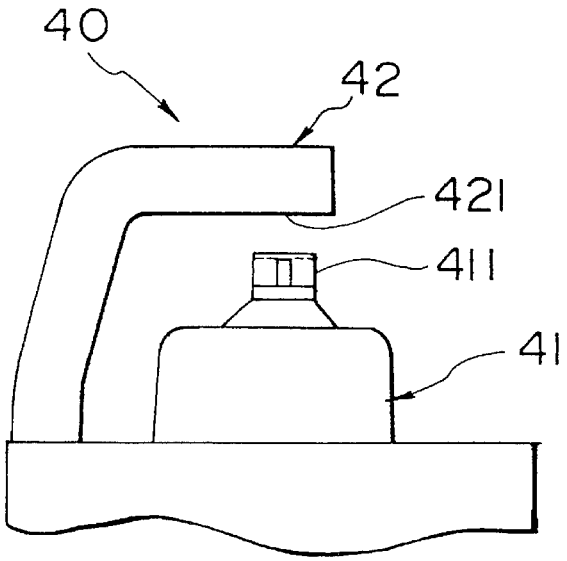
FIG. 11 is a view showing a metal tip of the present invention mounted on an electrode of a spark plug.
Figure 12:
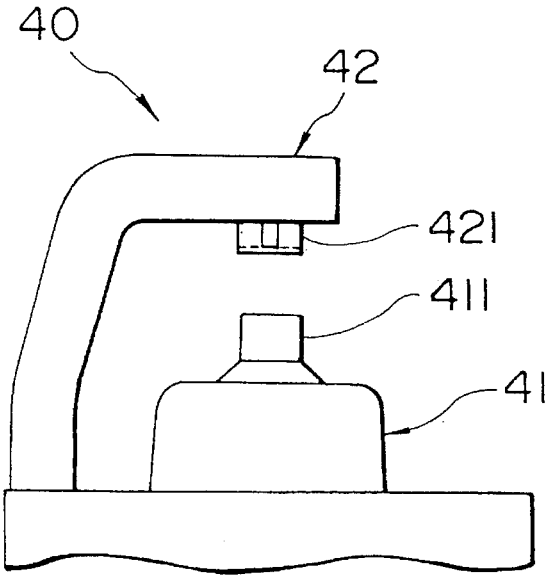
FIG. 12 is a view showing a metal tip of the present invention; mounted on an electrode of a spark plug.

On the other hand, where the connecting portion 28 is used as a discharge surface as shown in FIGS. 11 and 12, the discharge end is worn by a discharge to increase a gap for a certain period of time after the spark plug is used. As a result, the connecting portion 28 is completely exhausted or extinguished, so that the discharge surface is divided to reduce the area thereof, thus decreasing the required voltage. This advantageously cancels the increase of the required voltage due to the increase of the gap.

In the latter case, it is necessary that the thickness t of the connecting portion 28 should be not more than 0.3 mm, because when the discharge gap increases to about 0.3 mm, it is possible that a voltage produced by an igniter, or a voltage to be withstood by the igniter, may not be compatible with the increased gap, so that the spark plug may fail to operate before the connecting portion 28 is extinguished.

Therefore, it is necessary to decrease the required voltage before that time, and hence the thickness t of the connecting portion 28 needs to be not more than 0.3 mm.

In the above embodiment, although the metal tips of a cylindrical shape are produced, the shape of the metal tips may be of any other suitable pillar shape having an oval cross-section, a polygonal cross-section or other cross-section.

What is claimed is:

1. A method of producing a metal tip having a recess formed therein, the method comprising the steps of:

providing a metal blank having opposing first and second ends;

driving a punch partway into the first end of the metal blank toward the second end thereof, thereby forming the recess, whereby a portion of the metal of the metal blank is displaced by the punch to form a projection extending from the second end of the metal blank in alignment with the recess; and separating the projection from the metal blank while maintaining the recess formed therein and while applying a force to all surfaces of the metal blank.

2. A method according to claim 1, wherein said step of separating the projection from the metal blank is performed by applying a shearing force to the projection.

3. A method according to claim 1, wherein said step of forming the recess comprises forming a recess having one of a elongate groove-shape, a cross-shape, a Y-shape, a circular shape, and a rectangular shape.

4. A method according to claim 2, wherein said step of applying a shearing force comprises applying balanced and oppositely-acting forces to the metal blank and to the projection, respectively, in a direction substantially perpendicular to a line of action of the punch.

5. A method according to claim 2, wherein said shearing step includes applying at least one force to one of the metal blank and the projection along a direction substantially perpendicular to a line of action of the punch.

6. A method according to claim 1, wherein said step of providing a metal blank includes providing an elongate metal blank having an axis along a direction of elongation thereof and orienting the elongate metal blank so that the axis is substantially aligned with a direction along which the punch acts.

7. A method according to claim 1, wherein said step of applying a force to all surfaces of the metal blank includes placing the punch in contact with at least one surface of the recess during said step of separating the projection from the metal blank.

8. A method according to claim 1, wherein said step of applying a force to all surfaces of the metal blank includes applying a compressive force to a distal end of the projection in a direction along a direction of extension of the projection during said step of separating the projection from the metal blank.

9. A method according to claim 1, including, prior to said step of driving the punch partway into the first end of the metal blank, a step of sandwiching the metal blank between a punch guide associated with the punch and a lower die, the punch guide having an opening through which the punch is driven partway into the metal blank and the lower die having an opening formed therein in substantial alignment with the opening in the punch guide into which the projection projects.

10. A method of producing a metal tip having a recess formed therein, the method comprising the steps of:

inserting a metal blank into a die so as to have a substantially conformal fit between the metal blank and the die;

driving a punch partway into a first side of the metal blank received in the die thereby forming the recess in the metal blank, whereby a part of the metal of the metal blank is displaced so as to form a projection extending from a second side of the metal blank opposite from the first side and in alignment with the recess; and separating the projection from the metal blank by shearing while applying a force to all surfaces of the metal blank thereby forming the metal tip with a recess formed therein.

11. A method according to claim 5, wherein said step of inserting a metal blank into a die comprises providing an elongate metal blank having an axis along a direction of elongation thereof and orienting the elongate metal blank in the die so that the axis is substantially aligned with a direction along which the punch acts.

12. A method according to claim 10, wherein said step of applying a force to all surfaces of the metal blank includes placing the punch in contact with at least one surface of the recess during said step of separating the projection from the metal blank.

13. A method according to claim 10, wherein said step of applying a force to all surfaces of the metal blank includes applying a compressive force to a distal end of the projection in a direction along a direction of extension of the projection during said step of separating the projection from the metal blank.

14. A method according to claim 10, including, prior to said step of driving the punch partway into the first end of the metal blank, a step of sandwiching the metal blank between a punch guide associated with the punch and a lower die, the punch guide having an opening through which the punch is driven partway into the metal blank and the lower die having an opening formed therein in substantial alignment with the opening in the punch guide into which the projection projects.

* * * * *